United States Patent [19]

Jenkins, Jr.

[11] Patent Number: 4,502,185

[45] Date of Patent: Mar. 5, 1985

[54] SCREEN FOR CARDING MACHINES

[75] Inventor: Robert B. Jenkins, Jr., Gastonia, N.C.

[73] Assignee: Jenkins Metal Corporation, Gastonia, N.C.

[21] Appl. No.: 273,970

[22] Filed: Jun. 15, 1981

[51] Int. Cl.[3] ..... D01G 15/34

[52] U.S. Cl. ..... 19/95

[58] Field of Search ..... 19/95

[56] References Cited

U.S. PATENT DOCUMENTS

| | | | |
|---|---|---|---|
| 1,562,101 | 11/1925 | Lawton | 19/95 |
| 2,929,112 | 3/1960 | Massey et al. | 19/95 X |
| 3,348,268 | 10/1967 | Jenkins | 19/95 |
| 3,348,269 | 10/1967 | Jenkins | 19/95 |
| 3,559,804 | 2/1971 | Lytton | 19/95 X |
| 3,568,289 | 3/1971 | Jenkins | 19/95 X |
| 3,685,099 | 8/1972 | Jenkins | 19/95 |
| 4,157,601 | 6/1979 | Elliott | 19/95 |
| 4,224,717 | 9/1980 | Teichmann et al. | 19/95 X |

*Primary Examiner*—Louis K. Rimrodt

*Attorney, Agent, or Firm*—Clifton Ted Hunt

[57] ABSTRACT

A card screen with side frames and central rib penetrated with longitudinally spaced transverse openings and transverse bars equipped with pins and sockets supported in the transverse openings to secure the screen together without solder.

3 Claims, 19 Drawing Figures

SCREEN FOR CARDING MACHINES

BACKGROUND OF THE INVENTION

The manufacture and repair of screens extending about the lower periphery of the main cylinder of a carding machine is a time consuming procedure requiring the talents of skilled craftsmen. The screen extends about 40 to 45 inches across the carding machine parallel with the axis of the main cylinder and the combined length of the front and rear portions of the card screen ranges from 50 to 64 inches. Each of the front and rear sections are formed in an arc when viewed from the side and the two sections include means for connecting them together beneath the axis of the main cylinder in conforming relation to the curvature of the main cylinder. The card screen comprising the front and rear sections is spaced a predetermined distance measured in thousandths of an inch from the lower periphery of the main cyclinder. As the main cyclinder rotates at speeds approximating thirty five to fifty miles per hour trash and non-spinable fibers are thrown from the lap and passed through the air space between adjacent grid bars in the card screen.

The front and back screens each comprise side ribs extending along opposite sides of the screen and transverse blanks extending between the side ribs adjacent the doffer and the lickerin. End bars are provided in the proximal ends of the front and rear screen portions adjacent their juncture beneath the axis of the main cylinder. The end bars are formed of sturdy stock to effectively brace and strengthen the screen at its center. A plurality of grid bars extend transversely of the screen in parallel relation to the end bars. The grid bars are spaced from each other a predetermined distance longitudinally of the screen and the number of grid bars varies from screen to screen and is dependent on the length of the screen the width and spacing of the bars and the air space between adjacent bars. There may be as many as 82 bars in a card screen. Each of these bars, according to the prior art, is soldered to the side ribs and to a central rib, if one is provided. The grid bars may be spaced from each other along the length of the card screen about 3/16s of an inch and there is an approximate equal spacing between the grid bars and the proximate blank and end bar.

It is important to satisfactory carding that the spacing be uniform and this requirement of careful spacing and the need for skilled soldering of each rib causes the manufacture and repair of card screens to be a time consuming process requiring the services of skilled craftsmen. Another factor contributing to the time and skill required in the conventional manufacture and repair of card screens is the need to straighten the screen to it's predetermined configuration after the screen has been distorted by heat from the soldering operation. The completed screen must have a smooth surface in order to prevent tagging by the fibers as they pass the screen and this need for a smooth surface requires the removal of excess solder by grinding and polishing, thereby adding to the time and skill required in the manufacture and repair of screens for carding machines. The extensive use made of solder in the manufacture and repair of card screens according to the prior art undesirably exposes the workers to lead molecules which are hazardous to the worker's health.

Card screens frequently require repair because a "choke" or large clump of fibers passes between the main cyclinder and the card screen. The resulting pressure frequently causes some of the grid bars to become bent and/or disconnected from the supporting side ribs and, if provided, the central rib. Because of the skill required in assembling the components of a card screen to the close tolerances needed for effective carding the damaged screens are generally returned to the same skilled craftsmen who manufactured the original screen. Repair is accomplished by the same time consuming alignment, soldering, straightening and polishing techniques as were required in the initial manufacture of the screen.

SUMMARY OF THE INVENTION

According the present invention, the grid bars are connected to the side ribs and the central ribs, if provided, by pins and without the need of solder. The ribs are prepunched to accommodate the supporting pins in a predetermined spacing so that the grid bars are automatically desirably spaced when the screen is assembled, thereby eliminating the prior art need for carefully spacing the bars relative to each other during assembly to acquire the proper air space between bars.

More specifically, the grid bars are equipped with sockets at their ends adjacent the side ribs and pins are passed through corresponding holes prepunched in the side ribs and the pins are received withing the sockets to support the grid bars. In card screens equipped with a center rib the ends of the grid bars on one side of the center rib are equipped with axially extending pins and the grid bars on the other side of the central rib are equipped with sockets to receive the pins on the first group of grid bars after the pins have penetrated a corresponding hole through the central rib.

By providing predetermined desirably spaced openings along the longitudinal extent of the side and central ribs, the bars are automatically spaced the desired distance from each other and aligned with the bars on the other side of the central rib, when assembled.

The end bars may be equipped at their outer ends with sockets like those in the grid bars and the side ribs may be prepunched to register with the sockets in the end bars. Similarly, if a center rib is used the central rib may be prepunched and the end bars on one side of the central rib may be equipped with pins to penetrate the opening in the central rib while the end bars on the other side of the central rib are equipped with sockets to receive the pin from the aligned end bar on the other side of the central rib.

Some card screens do not have central ribs and in those screens the grid bars and end bars extend uninterruptedly between the side ribs and there is no need for providing pins on some of the bars, assuming it is desired to use sockets at the ends of the bars to register with openings prepunched in the side ribs.

It is therefore an object of this invention to provide a novel arrangement which permits the bars and the side and center ribs of a card screen to be united in a more economical and reliable manner than has heretofore been possible.

It is another object of the invention to provide a card screen comprising component parts which may be assembled by unskilled labor.

It is a still further object of the invention to provide a novel method of assembling a card screen in a shorter time than has heretofore been possible.

A still further object of the invention is to provide a card screen and method of assembly which results in a more reliably united card screen than has heretofore been possible.

It is a more specific object of the invention to provide a card screen of the type described wherein the supporting side ribs and central rib, if used, are prepunched prior to assembly of the screen, the prepunching of the ribs defining desirably spaced groups of openings, an alternatively providing sockets or pins in the ends of the grid bars proximate to the side ribs, and, if sockets are provided, providing pins registrable with the prepunched openings in the side ribs and with the sockets in the grid bars.

It is another object of the invention to provide a method of assembling a card screen which significantly reduces the amount of soldering heretofore required in assembling card screens, thereby keeping the configuration of the screen within tolerance and not requiring as much straightening time after the screen is assembled.

It is further object of the invention to provide a method of assembling card screens which reduces the time heretofore required in grinding and polishing the completed screen to remove excess solder and make the screen desirably smooth for it's intended function.

A still further object of the invention is to provide a method and means for repairing card screens more accurately and in less time than has heretofore been possible.

Another object of the invention is to provide a method of manufacturing and repairing card screens which reduces the amount of solder required to assemble the screen and thereby reduces the exposure of the workers to lead molecules.

DETAILED DESCRIPTION OF THE INVENTION

Figure 1:
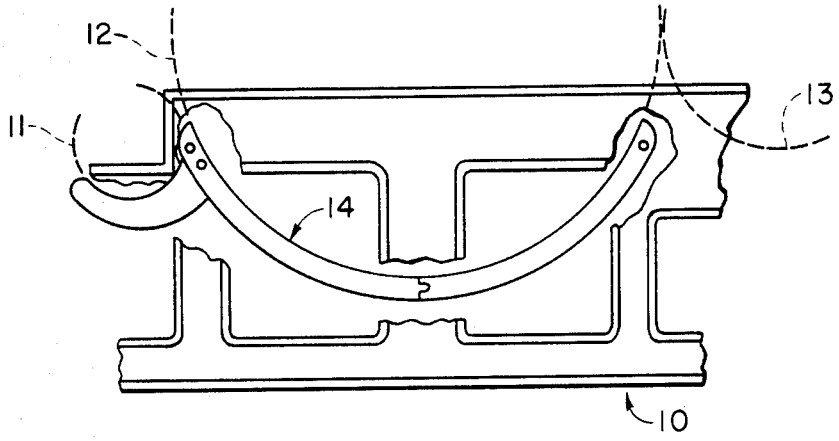
FIG. 1 is a fragmentary side view of a carding machine with parts broken away and showing the relationship of a carding screen with the main cylinder.
Figure 2:
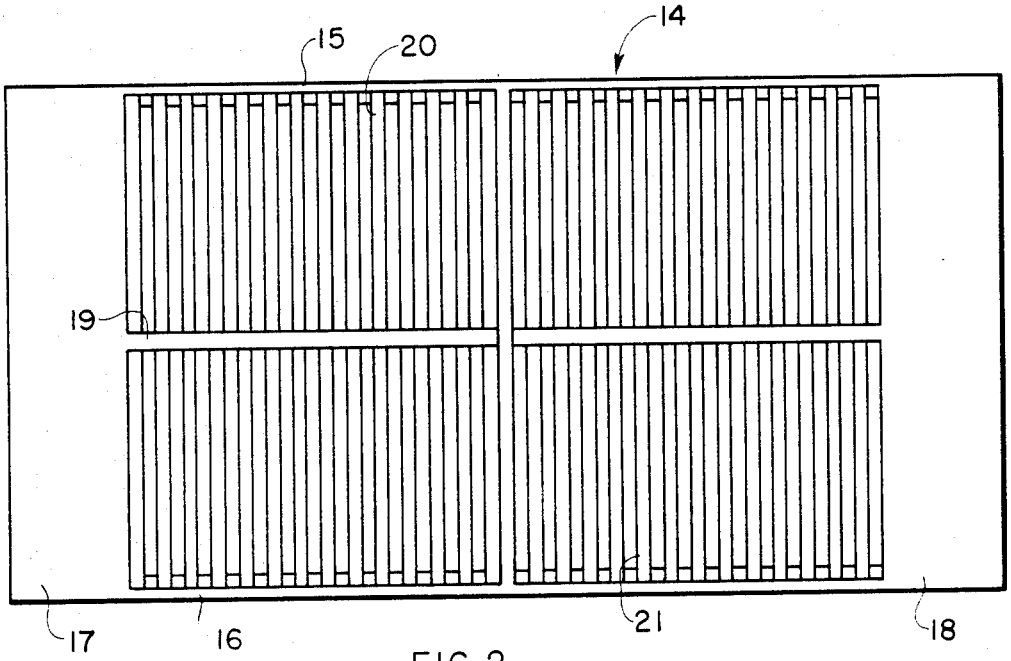
FIG. 2 is a top plan view of the front and back card screen sections removed from the carding machine.

Referring more specifically to the drawings, as best shown in FIG. 1, the numeral 10 broadly indicates a frame of a carding machine, only so much of the framework of the carding machine being shown as will be necessary to illustrate the essential features of the invention. The lickerin, main cylinder and doffer are schematically indicated at 11, 12 and 13, respectively. The main cylinder screen is broadly indicated at 14 and includes a front screen portion **14*a* and a back screen portion 14*b*. The screen, as best shown in FIG. 2, includes longitudinal side ribs 15 and 16 and transverse blanks 17 and 18 between which extends a longitudinal central rib 19**.

Figure 3:
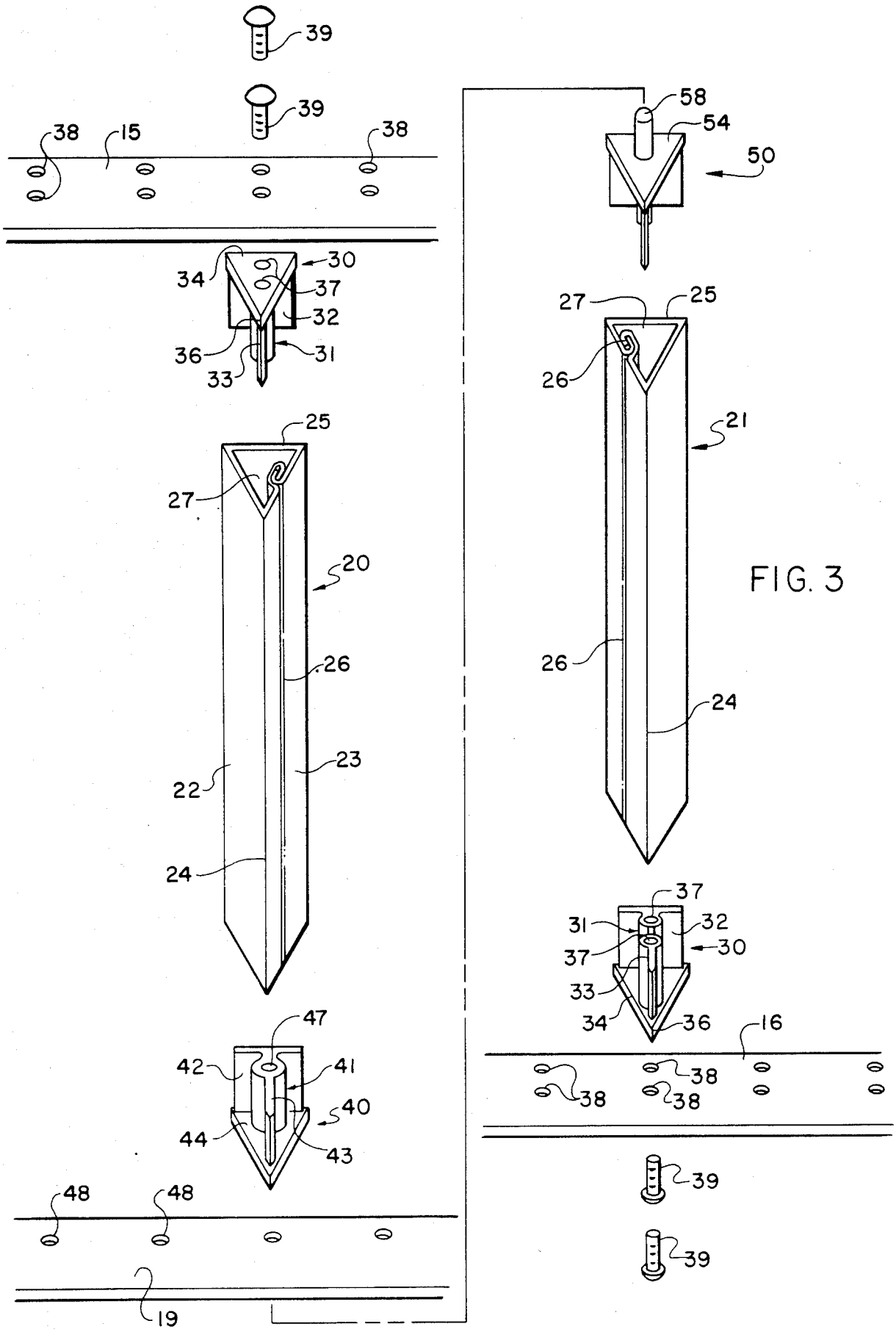
FIG. 3 is a fragmentary exploded schematic view perspectively illustrating the attachment of a pair of axially aligned grid bars to the side and center ribs of the screen.

A first group of longitudinally spaced bars 20 extend transversely from the side rib 15 to the central rib 19 and a second group of longitudinally spaced bars 21 extend transversely from the side rib 16 to the central rib 19. The bars 20 and the bars 21 are alike and are of any desired cross-sectional configuration; but in the embodiment illustrated, they are triangular in cross-section, as best shown in FIG. 3 and include opposed sides 22 and 23 which merge to define a pointed edge 24. The third side or face 25 of each bar 20 is opposite the pointed edge 24 and is desirably spaced from the main cylinder of the carding machine to separate foreign matter, lint and the like, from the fibers remaining on the main cylinder during the carding operation. The side 23 of each bar 20 and 21 is illustrated as including a seam 26 defined by overlapped ends of the material from which the bar is formed.

The bars 20 and 21 may be of a uniform dimension throughout their respective lengths and extend in uniformly spaced parallel relation to each other transversely of the screen to define a space of approximately 4.8 mm (3/16") bettween adjacent bars. This distance may be varied as desired. Alternatively, the bars 20 and 21 may be tapered inwardly from their respective junctures with the side frames toward their junctures with the center bar as described in U.S. Pat. No. 3,348,268 issued Oct. 24, 1967. End bars 27 extend transversely of the screen between side rib 15 and center rib 19. The end bars are positioned at the center of the screen in FIG. 2 and are proximate to each other when the front screen portion **14*a* and back screen portion 14*b* are assembled to form the complete screen. End bars 28 are aligned with the end bars 27 and extent between side rib 16 and center rib 19. The end bars are of tubular triangular configuration like the bars 20, 21**, but the end bars 27, 28 are of sturdier stock and do not include a seam such as indicated at 26 on the grid bars 20, 21. The end bars are conventionally soldered to the side ribs 15, 16 and center rib 19 and effectively brace the center of the screen.

The structure of the screen thus far described is conventional and the invention resides in providing improved means for effectively joining the ends of the grid bars 20 and 21 and end bars 27, 28 to the side ribs 15, 16 and the center rib 19, if used.

As best seen in FIG. 3, each of the grid bars in the first group of bars 20 and each of the bars in the second group of bars 21 is of a triangular, tubular configuration and is open, as at 27, at each end. A first female insert broadly indicated at 30 is inserted in the open end 27 of each bar in the first group of bars 20 and in the open end 27 of each bar in the second group of bars 21 adjacent their respective junctures with side ribs 15 and 16.

Figures 4, 5, 6, 7, 8, 9, 10, 11, 12, 13:
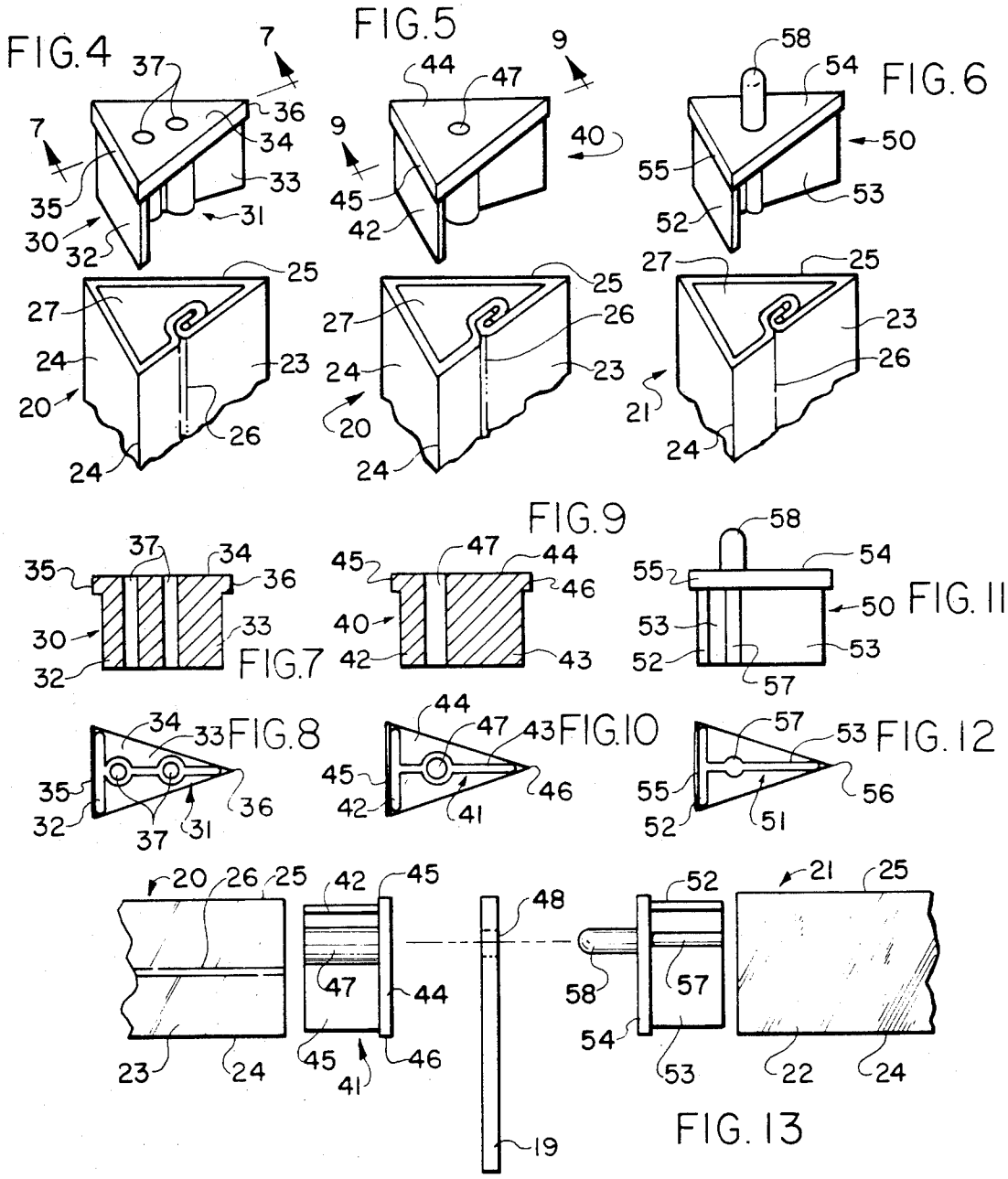
FIG. 4 is a perspective view of a first female insert removed from one end of a grid bar.
FIG. 5 is a perspective view of a second female insert removed from the other end of the grid bar.
FIG. 6 is a perspective view of a male insert removed from an end of a grid bar.
FIG. 7 is a horizontal sectional view taken substantially along the lines 7—7 in FIG. 4.
FIG. 8 is an inverted end view of the first female insert looking at the end opposite that shown in FIG. 4.
FIG. 9 is a vertical sectional view taken substantially along the line 9—9 in FIG. 5.
FIG. 10 is an inverted end view of the second female insert looking at the end opposite that shown in FIG. 5.
FIG. 11 is a side view of the male insert shown in FIG. 6.
FIG. 12 is an inverted end view of the male insert looking at the end opposite that shown in FIG. 6.
FIG. 13 is a fragmentary exploded elevation illustrating the self alignment of opposed bars when the pin of the male insert penetrates the opening in the center rib and seats in the socket of an opposed second female insert during assembly of the screen.

Each insert 30 includes a generally T-shaped supporting frame broadly indicated at 31 shaped to conform to the configuration of and be received within the opening 27 in the ends of the bars 20, 21 adjacent the side ribs 15, 16. The frame 31 includes a top wall 32 which is parallel with and seated beneath the face 25 of a bar 20 or 21 when assembled. The top wall 32 forms the top of the T and merges with a perpendicular leg 33 at the medial portion of top wall 32. The leg 33 extends toward the pointed edge 24 of it's bar 20 or 21 when assembled. The first female insert 30 also includes a triangularly shaped head 34 including an upper edge portion 35 spaced outwardly in overhanging relation from the top wall 32 of frame 31 FIGS. 4 and 7). The head 34 tapers downwardly and inwardly from the upper edge portion 35 to a pointed end 36 spaced outwardly beyond the end of leg 33 remote from top wall 32. The leg 33 has a pair of circular bores or sockets 37 which also penetrate the head 34. The sockets are spaced along the leg 33 with one socket adjacent the top wall 32 and other socket about midway between the top wall 32 and the opposite end of leg 33. When the inserts 30 are assembled in the distal ends of respective bars 20, 21 the seams 26 on the bars 20, 21 fit in the space between the walls of the sockets 37. The ends of the top walls 32 of these inserts bear against the proximal inner surfaces of the grid bars 20, 21 and the opposite ends of the legs 33 bear against the inner surfaces of pointed edges 24 on the grid bars 20, 21 to frictionally retain the inserts in the grid bars with their heads 34 protruding beyond the bars in overlapping relation to the distal ends of the bars. The length of the supporting frames 31 from heads 34 is not critical except that they extend within the bars sufficiently to provide a stable frictional connection of the insert to the bar. The heads 34, of course, limit inward movement of the inserts 30 relative to respective bars.

Each side rib 15 and 16 includes equally spaced groups of transverse openings 38 arranged longitudinally along the side ribs and dimensioned to register with sockets 37 and receive pins 39 which are preferably annularly grooved as at G (FIG. 3) to increase frictional resistance. It is contemplated that in some instances the inserts 30 may include only a single socket 37 and the side ribs 15, 16 will include a like number of openings 38 to register with the sockets 37 in inserts 30. The term "group" refers to one or more openings in the ribs registrable with a like number of sockets in the inserts 30.

The inner end of each grid bar in the first group of bars 20 extends toward the center rib 19 and its open end 27 receives a second female insert 40. Each insert 40 includes an inner support frame 41 comprising top wall 42 and leg 33. Frame 41 is a substantial duplicate of the T-shaped frame 31 of the insert 30. The inner frame 41 fits within the open ends 27 of the bars 20 adjacent the center rib 19 and are frictionally retained therein by the engagement of the inner frames with the inner surfaces of the bars 20.

The second female inserts 40 differ from the first female inserts 30 only in that legs 43 have only a single relatively large diameter socket 47 which is located closely adjacent top wall 42 and extends through head 44 for registry with a selected one of a plurality of transverse openings 48 arranged along the length of central rib 19. The wall of the socket 47 frictionally engages the seam 26 on its bar 20 to help retain the frame 41 within the bar 20.

It is contemplated that one or more sockets 47 may be in the inserts 40 and a like number of openings 48 will be provided in the central rib for registry with the sockets 47. See FIG. 14. The openings 48 in the central rib 19 are referred to as groups of openings for each insert 40 even though in the illustrated form of invention each such group contains only one opening.

Figure 14:
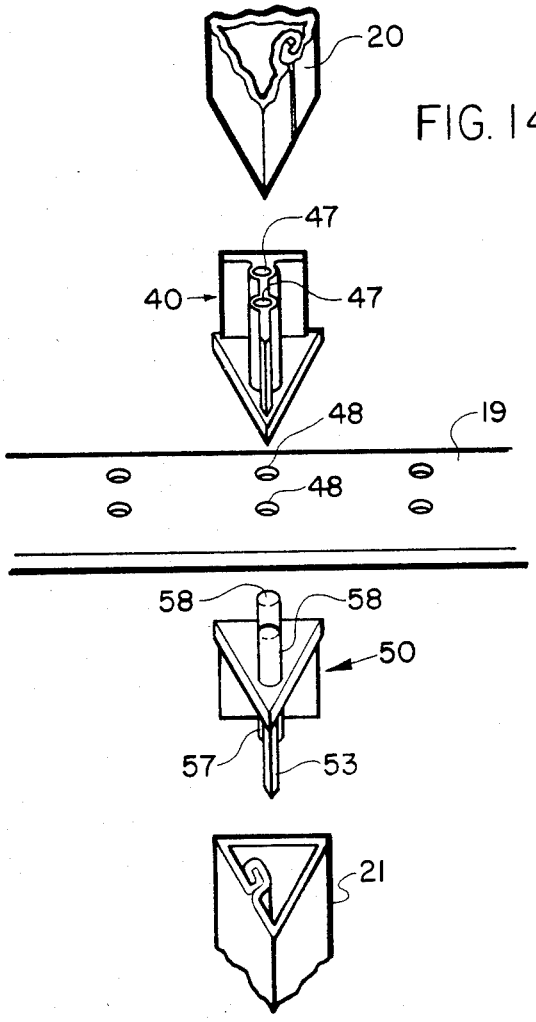
FIG. 14 is a fragmentary exploded perspective view of an alternate form of the invention.

Each grid bar in the group of bars 21 has an insert generally indicated at 50 inserted in its open and 27 adjacent the center rib 19 and opposite first female insert 30. The inserts 50 include an inner support frame 51 which is like the frames 31 and 41 except the frame 51 does not have any cavity. It's leg 53 is preferably with a circular boss 57 for strengthening and for frictional engagement with the seam 26 on the bars to help retain the frame 51 within bar 21. A head 54 overlies the proximal end of frame 51 and a pin or pins 58 extend outwardly for registry with a corresponding group of openings 48 in central rib 19 and for reception in a corresponding number of sockets 47 in the inserts 40 (FIGS. 3 and 14).

METHOD OF ASSEMBLY

Figure 15:
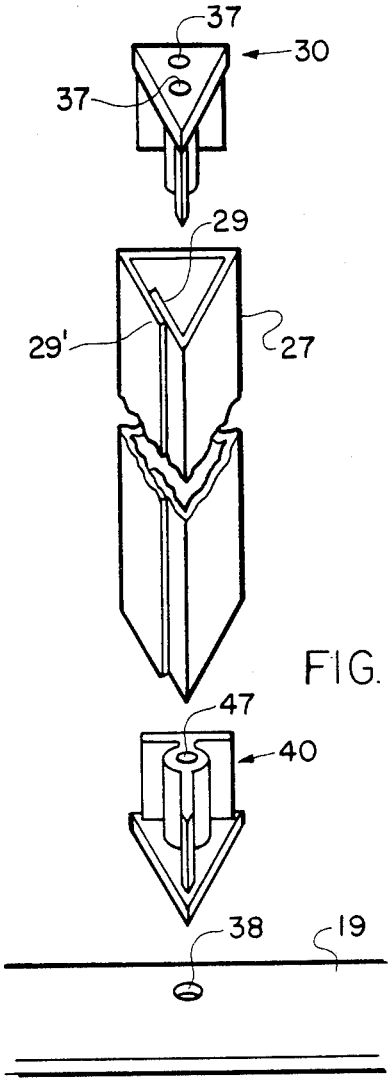
FIG. 15 is a fragmentary exploded schematic view perspectively illustrating the use of inserts to connect the end bars to the supporting side and center ribs.
Figure 17:
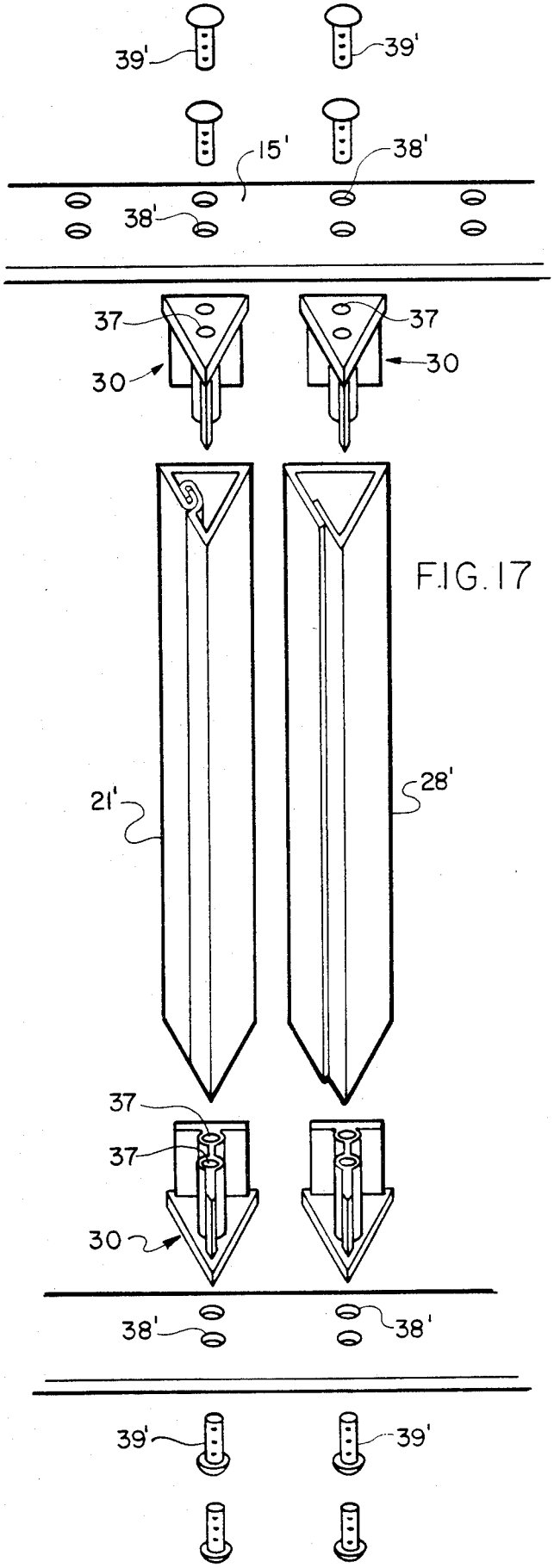
FIG. 17 is a fragmentary perspective view with parts broken away illustrating the use of prepunched side ribs and supporting pins to assemble grid bars and end bars in a carding screen without a central rib.

The end bars 27, 28 are identical to each other and may be equipped with properly dimensioned inserts like the inserts 30, 40 and 50 for registry with corresponding groups of openings in the side and center ribs. An end bar 27 is shown in FIGS. 15 and 17 being of heavier gauge material than the grid bars 20, 21 and the end portions 29 and 29′ are simply overlapped instead of being turned on themselves to form a seam as are the end portions of the grid bars 20, 21. The overlapping end portion 29 rests against the inner frame of the corresponding insert 30, 40 or 50 like the seam 26 on the grid bars.

Figure 16:
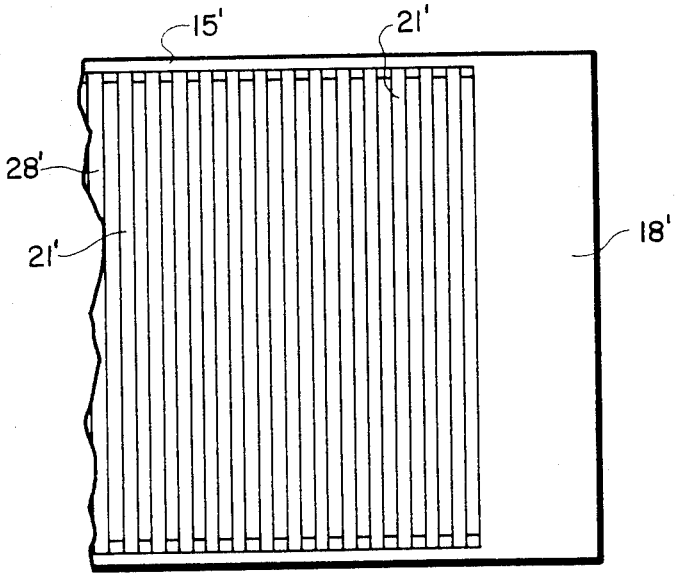
FIG. 16 is a plan view of a carding screen without a central rib.

It is conventional practice to make some card screens without the center rib and such a card screen is illustrated at 14′ in FIGS. 16 and 17. The card screen 14′ includes the conventional side ribs 15′, 16′ and the conventional blanks 17′ and 18′, the blank 17′ being omitted from the fragmentary view of FIG. 16. The screen 14′ also includes the usual grid bars and end bars shown at 21′ and 28′ respectively in FIG. 16. The construction of the grid bars and end bars 21′, 28′ is like that of the grid bars 20, 21 and end bar 27 previously described.

The components of the screen 14′ are assembled by use of inserts 30 at the ends of the grid and end bars to receive pins 39′ extending through the side ribs 15′, 16′ in the manner previously described in connection with the first described embodiment of the invention.

Figure 18:
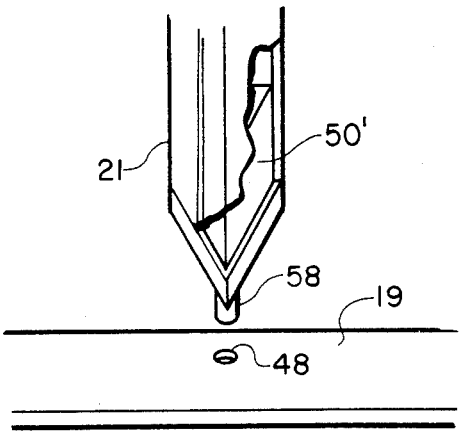
FIG. 18 is a fragmentary exploded perspective view of a modified form of the invention illustrating a grid bar with pins and sockets molded directly into the open ends of the bar; and FIG. **18*a* is a transverse sectional view through an end portion of the grid bar shown in FIG. 18**.
Figure 18A:
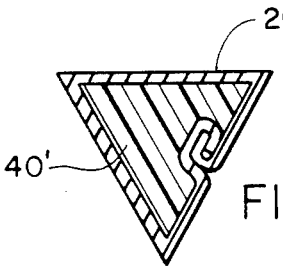

A further modified form of the invention is illustrated in FIGS. 18 and 18*a*, wherein the inserts 30, 40 and 50 may be formed integral with the grid bars and end bars. The integral bars and inserts may be used in making the screen with the center rib 19 as illustrated in FIGS. 16 and 17, and reference is made to the screen components in FIGS. 18 and 18*a* with the same reference numbers as used to describe corresponding components in the first embodiment of the invention. The parts are assembled in the same way and no further description is deemed necessary to describe the assembly of the components with the integrated inserts and bars. Referring to FIG. 18*a*, it will be noted that the integrated insert 40' completely fills the tubular opening in the grid bar 21 and does not have the T-shaped inner frame of the insert 40.

After the components of the screen 14 comprising the side frames with their longitudinally spaced groups of openings 48, triangularly shaped tubular bars 20, 21, with their open ends 27 and the inserts 30, 40 and 50 have each been fabricated, the screen 14 is assembled by arranging successive pairs of bars 20 and 21 on opposite sides of the central rib 19, with the pins 58 on inserts 50 (FIGS. 3 and 14) aligned with openings 48 in the rib 19 and with the sockets 47 in the inserts 40 in registry with corresponding openings 48 in the central rib 19. The next step is to pass the pins 58 through the openings 48 and into the sockets 47 to connect the aligned pairs of bars 20, 21 in axial alignment with each other. Next, the sockets 37 in the distal ends of the aligned pair of bars 20, 21 are placed in registry with opposed openings 38 in side ribs 15, 16 and the pins 39 are passed through their respective side ribs and fastened in the sockets 37 to provide a stable connection of the pairs of aligned bars 20, 21 to side ribs and central rib.

The spacing of the groups of openings in the center rib 19 automatically aligns the bars and insures that they are arranged parallel to one another with the proper spacing between the bars on each side of the central rib, while at the same time insuring that the group of bars 20 on one side of the central rib 19 are axially aligned with their corresponding bars 21 on the other side of the central rib.

There is thus provided a novel arrangement for assembling the bars of a screen to the supporting frame which enables the screen to be formed more quickly with less skilled labor and which at the same time assures proper spacing and alignment of the bars relative to each other and to the frame of the screen. The automatic self-alignment and spacing is provided by the longitudinally spaced openings 38 in the side ribs 15 and 16 by the longitudinally spaced groups of openings 48 in the center rib. The sequential alignment of the bars with these openings and the placement of the pins through the openings automatically aligns and spaces the end bars and grid bars as they are attached to the ribs to form the screen.

I claim:

1. In a card screen having longitudinally extending side ribs and a center rib and transversely extending end and grid bars, the combination of each side rib having a plurality of openings extending therethrough and arranged in predetermined longitudinally spaced relation to each other, the center rib having a plurality of groups of openings extending therethrough and said groups being arranged in predetermined longitudinally spaced relation to each other, a first group of bars on one side of the center rib extending between one side rib and the center rib, a group of pins extending from each bar in the first group toward the center rib, a second group of bars extending between the other side frame and the center rib and each bar in the second group of bars having a group of sockets in it's end adjacent the center rib registrable with a selected group of openings in the center rib and receptive of the group of pins extending from an opposing bar in the first group of bars, each side rib having longitudinally spaced groups of openings effectively aligned with the groups of openings in the center rib, and fastening means penetrating the openings in the side ribs for connecting the bars to the side ribs.

2. In combination with a card screen having longitudinally extending side ribs and a center rib and first and second groups of transversely extending bars with the bars in one group axially aligned with the bars in the other group and the bars in both groups arranged in predetermined longitudinally spaced parallel relation to ach other, inserts positioned in both ends of the bars in both groups, the inserts in the ends of the bars adjacent the center rib in a first group including pins extending axially of the bar toward the center rib, the inserts in the proximal ends of the bars in the second group having sockets extending axially of the bars and opening toward the center rib, the inserts in the distal ends of the bars in both groups having sockets extending axially of the bars and opening toward respective side ribs, and the side ribs and center rib having openings spaced longitudinally from each other a predetermined distance, the sockets in the distal ends of the bars being registrable with the openings in respective side ribs and the pins and sockets in the proximal ends of the groups of bars being registrable with the openings in the center rib and with each other to align the bars in a predetermined longitudinally spaced parallel relation to each other with the bars in the first group being axially aligned with the bars in the second group, and fastening means penetrating the openings in the side ribs and engaged with the sockets in the distal ends of the bars to complete the screen.

3. A structure according to claim 2 wherein the inserts are molded integral with the bars.

* * * * *